US005368432A

United States Patent [19]

Schoenhard

[11] Patent Number: 5,368,432

[45] Date of Patent: Nov. 29, 1994

[54] APPARATUS AND METHOD FOR OPENING PLASTIC BAGS CONTAINING RECYCLABLE MATERIALS

[76] Inventor: James D. Schoenhard, P.O. Box 325/59 Country Lake Estates, Athens, Ill. 62613

[21] Appl. No.: 58,636

[22] Filed: May 6, 1993

[51] Int. Cl.[5] ..... B65B 69/00

[52] U.S. Cl. ..... 414/412; 209/3; 209/930; 241/186.35; 241/DIG. 38

[58] Field of Search ..... 414/412, 786; 241/186, 241/35, DIG. 38, 193–195; 209/3, 930

[56] References Cited

U.S. PATENT DOCUMENTS

| | | | |
|---|---|---|---|
| 1,916,531 | 7/1933 | Robb | 414/412 |
| 4,162,019 | 7/1979 | Joa | 414/412 |
| 4,289,438 | 9/1981 | Murer | 414/412 |
| 4,515,509 | 5/1985 | Frisz | 414/412 |
| 4,725,184 | 2/1988 | Bennisor | 414/412 |
| 5,188,500 | 2/1993 | Eide et al. | 414/412 |
| 5,197,678 | 3/1993 | Trezek et al. | 241/DIG. 38 X |

FOREIGN PATENT DOCUMENTS

| | | | |
|---|---|---|---|
| 2622172 | 4/1989 | France | 414/412 |
| 85127 | 3/1990 | Japan | 414/412 |

*Primary Examiner*—David A. Bucci

*Attorney, Agent, or Firm*—Willian Brinks Hofer Gilson & Lione

[57] ABSTRACT

An apparatus for opening plastic bags containing recyclable materials includes a feed conveyor for transporting the plastic bags from a receiving area to a sorting area, and a plurality of bag opener units positioned along the feed conveyor. Each of the bag opener units includes a flexible line connected to a rotating head. Free ends of the whirling lines shred and open the plastic bags as they are rotated by the rotating heads and as the plastic bags are transported along the feed conveyor.

16 Claims, 2 Drawing Sheets

Fig. 3
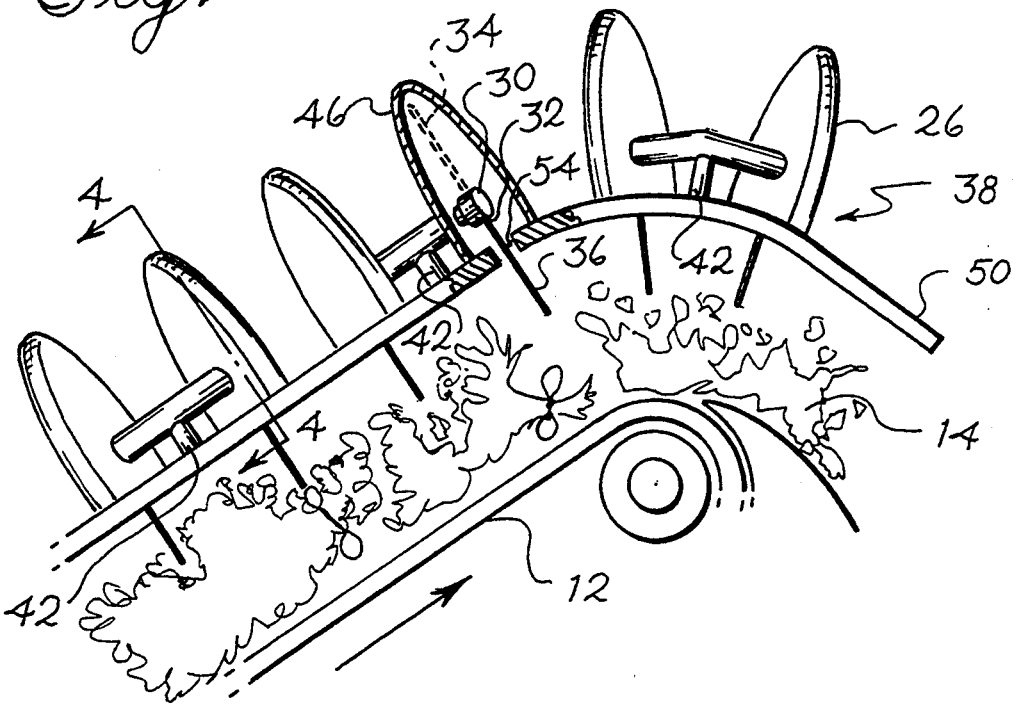
Fig. 4
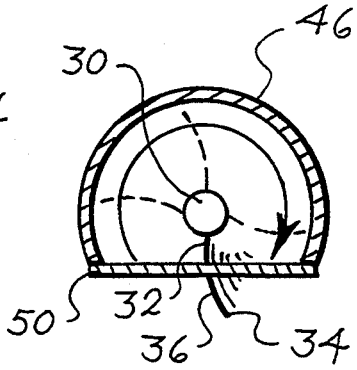
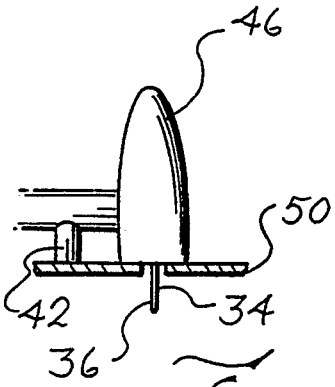
Fig. 5
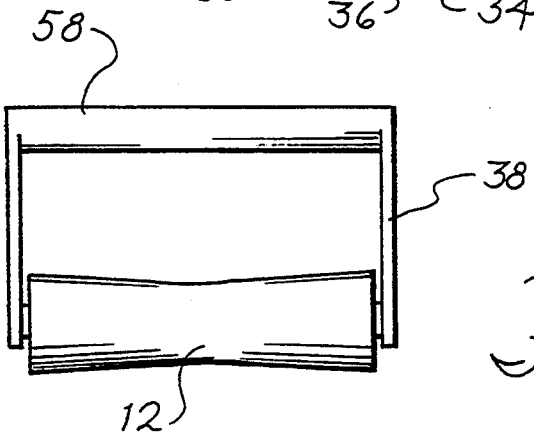
Fig. 6

APPARATUS AND METHOD FOR OPENING PLASTIC BAGS CONTAINING RECYCLABLE MATERIALS

BACKGROUND OF THE INVENTION

The present invention relates generally to the field of materials recycling and, more particularly, to a method and apparatus for opening plastic refuse bags containing recyclable materials.

Due to heightened concerns regarding resource conservation and environmental problems, the popularity of and need for materials recycling has greatly increased over the recent years. Consequently, numerous states and communities across the country have implemented mandatory refuse recycling programs. These programs all result in several recyclable refuse materials (e.g., glass, metal, plastic, paper, etc.) being separated from non-recyclable materials and recycled. However, the programs themselves often vary. For example, a common recycling program requires individuals to separate recyclable and non-recyclable materials before refuse collection. A second program utilizes different refuse collection days—one refuse collection day for recyclable refuse materials and a second refuse collection day for non-recyclable materials. A third type of program does not require individuals to separate recyclable and non-recyclable refuse materials. Rather, the refuse is collected and the recyclable and non-recyclable refuse materials are separated at a processing facility.

Regardless of the recycling program, plastic refuse bags are typically used to store and transport refuse. These plastic refuse bags must be opened to sort the recyclable and non-recyclable materials contained therein. At least two methods are presently used to open plastic refuse bags.

The first method utilizes a Trommel screen for opening plastic refuse bags. A Trommel screen consists of an open-ended, barrel-shaped screen having a number of blades attached to the inside wall thereof. As a conveyor transports refuse bags through the Trommel screen, the screen rotates and thereby causes the blades to lift and tear the refuse bags. Unwanted materials such as dirt, stones, etc. pass through the small screen holes in the Trommel screen, while the remainder of the refuse continues along the conveyor and is processed. While the Trommel screen has been satisfactorily used to open plastic refuse bags, the shape and rotation of the blades often causes them to throw and break recyclable materials (i.e., glass bottles and the like).

The second method uses a series of slowly rotating tines to open the refuse bags. The tines are positioned along the sides of a refuse bag conveyor. As the bags pass alongside the tines, the tines open the bags and cause the bags and their contents to be dumped onto the conveyor for subsequent processing. As with the Trommel screen described above, the rotating tines often break recyclable materials. Also, plastic refuse bags frequently become "hung up" on the rotating tines, which periodically requires the conveyor to be shut down and the plastic bags removed from the tines.

It is, therefore, an object of the present invention to provide a novel apparatus and method for opening plastic refuse bags.

It is another object of the present invention to provide an apparatus for opening plastic refuse bags which does not break recyclable materials.

It is still another object of the present invention to increase the efficiency and cost-effectiveness of refuse facilities.

It is yet another object of the present invention to facilitate the recycling of recyclable materials and to aid the marketing of products made from recycled materials.

SUMMARY OF THE INVENTION

According to a first aspect of the present invention, an apparatus for opening plastic bags containing recyclable materials includes a feed conveyor for transporting the plastic bags from a receiving area to a sorting area, and a plurality of bag opener units positioned along the feed conveyor. Each of the bag opener units comprises a flexible like, such as a plastic filament or a stainless steel wire, connected to a rotating head, whereby free ends of the lines strike and shred open the plastic bags as the lines are rotated by the rotating heads and as the plastic bags are transported along the feed conveyor.

According to a second aspect of the present invention, an apparatus for opening plastic bags containing recyclable materials includes a conveyor hood positioned along a conveyor transporting the plastic bags. A plurality of bag opener units is connected to the conveyor hood. The bag opener units each comprise a flexible line, as described above, connected to a rotating head. Free ends of the lines open the plastic bags as the lines are rotated by the rotating heads and as the plastic bags are transported through the conveyor hood by the conveyor.

According to a third aspect of the present invention, a method of processing plastic bags containing recyclable materials includes a step of conveying the plastic bags from a receiving area to a sorting area by means of a feed conveyor. The plastic bags are struck and opened by free ends of whirling lines connected to rotating heads. The contents of the opened plastic bags are then sorted.

The present invention facilitates the processing of recyclable materials by providing a quick, efficient and cost-effective means for opening plastic refuse bags containing these materials. Furthermore, since the present invention practically eliminates the breakage of recyclable materials and, thereby, reduces costs, the recycling of materials and the marketing of products made from recycled materials will be increased.

The invention itself, together with further objects and attendant advantages, will best be understood by reference to the following detailed description taken in conjunction with the accompanying drawings.

BRIEF DESCRIPTION OF THE DRAWINGS

FIG. 3 is an enlarged view of the bag opener units shown in FIG. 1, partially in section.

FIG. 4 is a cross-sectional view of a bag opener unit taken along line 4—4 of FIG. 3.

FIG. 5 is a front view of a bag opener unit shown in FIG. 1.

FIG. 6 is a cross-sectional view taken along line 6—6 of FIG. 1.

DETAILED DESCRIPTION OF THE PRESENTLY PREFERRED EMBODIMENT

Figures 1, 2:
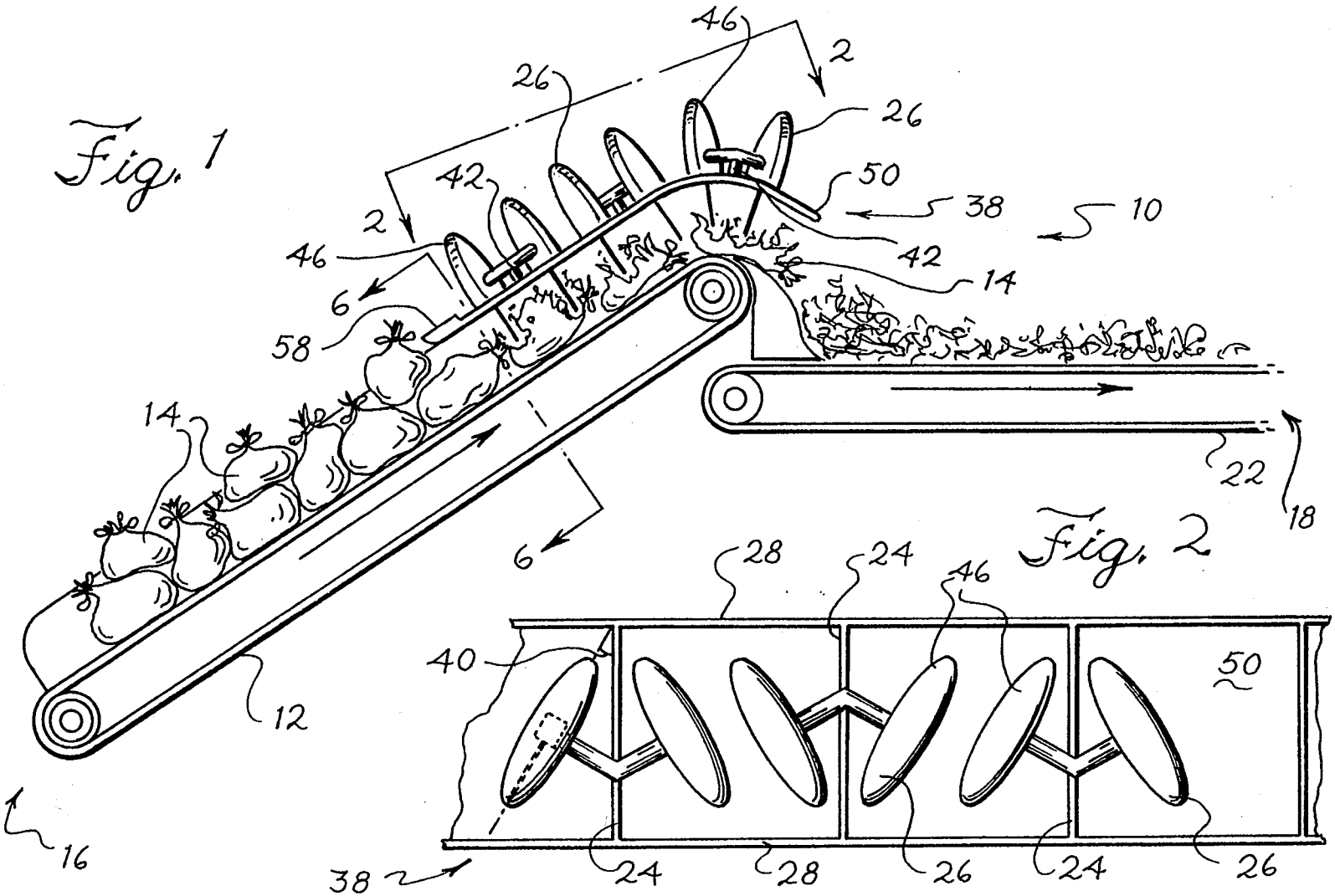
FIG. 1 is a side elevational view of a preferred embodiment of the present invention, with the sides of the conveyor hood removed.
FIG. 2 is a plan view taken along line 2—2 of FIG. 1.

In the drawings, FIG. 1 shows a conveyor system 10 for a solid refuse facility that incorporates the preferred embodiment of the present invention. The conveyor system 10 comprises a feed conveyor 12 which transports plastic refuse bags 14 from a receiving .area 16 to a sorting or processing area 18 where recyclable and non-recyclable materials are separated and sorted. Also, a sorting or processing conveyor 22 is positioned to receive the opened refuse bags 14 from the feed conveyor 12 and transports the opened refuse bags 14 through the sorting area 18. A plurality of bag opener units 26 is positioned along and above the feed conveyor 12.

As best shown in FIGS. 3–5, each of the bag opener units 26 comprises a rotating head 30 having a flexible line 34 connected thereto. A free end portion 36 of the line 34 is whirled about the rotating head 30 and another portion 32 of the line 34 is attached to the head 30. Each of the bag opener units 26 may include a cover 46 partially enclosing and protecting the head 30 and the line 34. Preferably, an electric motor (not shown) drives each rotating head 30, which causes the lines 34 to be rotated at high speed. Alternately, however, any suitable type of power source can drive the heads 30, including an hydraulic motor or a pneumatic motor. Furthermore, a single power source may be used to drive all of the rotating heads 30.

As best illustrated in FIGS. 1 and 3, when the plastic refuse bags 14 are transported by the feed conveyor 12 past the bag opener units 26, the rotating lines 34 contact and tear open the refuse bags 14, which results in the shredded refuse bags 14 and the contents thereof being dumped onto the feed conveyor 12 and, eventually, onto the sorting conveyor 22. This allows the recyclable and non-recyclable refuse to be more readily separated and sorted, usually by hand, in the processing area 18. Any suitable number of bag opener units 26 may be positioned along the feed conveyor 12. However, the number of bag opener units 26 necessary to completely shred all of the plastic refuse bags 14 transported from the receiving area 16 should be positioned along the feed conveyor 12, with a number of spares for servicing broken lines 34, etc.

As best shown in FIGS. 1–3, the bag opener units 26 are connected to a conveyor hood 38 that covers the top and the sides of the feed conveyor 12. The conveyor hood 38 may either be positioned along or mounted to the feed conveyor 12. The conveyor hood 38 prevents refuse from being thrown off of the feed conveyor 12 by the rotating lines 34, which could injure personnel working in the refuse facility.

The conveyor hood 38 includes a slotted plate 50 disposed between the bag opener units 26 and the feed conveyor 12. The bag opener units 26 are connected to the conveyor hood 38 by means of support bars 42 extending upwardly from the slotted plate 50. As best shown in FIG. 2, the bag opener units 26 are also connected to reinforcing bars 24 which extend between the sides 28 of the conveyor hood 38. The reinforcing bars 24 are preferably formed of angle iron and function to support the bag opener units 26 and to strengthen the conveyor hood 38.

As best shown in FIGS. 2 and 3, the bag opener units 26 are connected to the conveyor hood 38 at an angle 40 to the centerline of the feed conveyor 12. The slots 54 in the slotted plate 50 are cut at the same angle 40 so that the bag opener units 26 and the slots 54 are aligned. This alignment of the slots 54 and the bag opener units 26 permits the lines 34 to extend through the slots 54 and into contact with the refuse bags 14. The slots 54 are angled rather than being perpendicular to or parallel to the centerline of the feed conveyor 12 because less plate material is used that way and, therefore, the plate 50 is stronger and better able to support the bag opener units 26. In the preferred embodiment, the angle 40 is 30°. However, the slots 54 and the bag opener units 26 may be positioned at any suitable angle.

Furthermore, as shown in FIG. 1, the feed conveyor 12, or, alternately, the conveyor hood 38, may have a leveling bar 58 attached thereto at a selected height above the feed conveyor 12 for arranging the plastic refuse bags 14 along the feed conveyor 12 so that each plastic bag 14 is assured of being individually exposed to and opened by the bag opener units 26. Otherwise, if the bags 14 enter the conveyor hood 38 in a bunched or stacked relationship, some bags 14 may not be opened by the lines 34.

Preferably, as shown in FIGS. 1–3, the bag opener units 26 are mounted directly above the feed conveyor 12 in such a way that the plane of rotation of the heads 30 and the flexible lines 34 forms an angle with the direction of travel of the feed conveyor 12. However, the bag opener units 26 may be mounted to the conveyor hood 38 in any suitable orientation with respect to the feed conveyor 12. For example, the bag opener units 26 may be positioned such that the plane of rotation of the heads 30 is parallel to the direction of travel of the feed conveyor 12, or the orientation of individual bag opener units 26 may be varied. Additionally, instead of being positioned above the feed conveyor 12, the bag opener units 26 may be connected to the conveyor hood 38 such that they are positioned along the sides of the feed conveyor 12.

Preferably, as shown in FIG. 1, the bag opener units 26 are positioned at the end of the feed conveyor 12 proximate to the sorting conveyor 22. Alternately, however, the bag opener units 26 may be positioned at any suitable location along the feed conveyor 12.

The lines 34 may be of any suitable length and, therefore, the slotted plate 50 and the bag opener units 26 may be positioned at any suitable height above the feed conveyor 12. Preferably, however, the slotted plate 50 is positioned 12" above the feed conveyor 12 and the lines 34 extend 7" below the slotted plate 50.

As is commonly known from lawn trimming tools, leaf shredders, and like equipment, a cut length of the line 34 can be attached at its center to the rotating heads 30 by screws or the like, or the line 34 can be fed from a spool carried on the rotating heads 30. Spools of this type are well known and may be found in weed trimming tools sold under the trademark WEED EATER.

The lines 34 may be formed of any material suitable for the application, including plastic, steel and stainless steel. Additionally, the lines 34 may be comprised of braided steel wire, metal chain, or jointed metal wire. However, the mass of each line 34 should not be such that an undue amount of recyclable material is broken by the line 34 during operation.

The following materials have been found to be suitable for use in the present invention: the line 34 may be 0.08" diameter plastic line supplied by Poulan; the electric motor may be a ¾ horsepower motor; and the rotating heads 30 may be those found in weed trimming tools sold under the trademark WEED EATER. Also, the feed conveyor 12 and the sorting conveyor 22 may be a 24" wide or a 36" wide conveyor. Furthermore, the conveyors 12, 22 may either be "belt" conveyors or "sided-belt" conveyors.

It should be appreciated that the present invention may be configured as appropriate for the application. The embodiments described above are to be considered in all respects only as illustrative and not restrictive. The scope of the invention is indicated by the following claims rather than by the foregoing description. All changes which come within the meaning and range of equivalency of the claims are to be embraced within their scope.

What is claimed is:

1. An apparatus for opening plastic bags containing recyclable materials, the apparatus comprising:

a) a feed conveyor for transporting the plastic bags from a receiving area to a sorting area; and b) a plurality of bag opener units positioned along said feed conveyor, each of said bag opener units comprising a flexible line with one portion connected to a rotating head and another portion having a free end, and a cover opposite said feed conveyor to partially enclose the rotating head and the flexible line, whereby the free end of each line strikes and opens the plastic bags as the line is rotated by its rotating head and as the plastic bags are transported along said feed conveyor.

2. The apparatus of claim 1, further comprising a sorting conveyor which receives the opened plastic bags and the recyclable materials contained therein from said feed conveyor and transports the opened plastic bags and the contents thereof through the sorting area.

3. The apparatus of claim 2 wherein said plurality of bag opener units are positioned along an end of said feed conveyor proximate to said sorting conveyor.

4. The apparatus of claim 1 wherein the flexible lines are formed of a material selected from the group consisting of plastic, steel, and stainless steel.

5. The apparatus of claim 1, further comprising a leveling bar positioned at a selected height above said feed conveyor and between the receiving area and said plurality of bag opener units, whereby said leveling bar operates to arrange the plastic bags along said feed conveyor such that each plastic bag is individually exposed to and opened by said plurality of bag opener units.

6. The apparatus of claim 1 wherein all of said plurality of bag opener units are positioned above said feed conveyor.

7. The apparatus of claim 1 wherein at least two of said plurality of bag opener units are positioned along said feed conveyor such that a plane of rotation of the rotating heads and the flexible lines forms an angle with the centerline of said feed conveyor.

8. (Amended) An apparatus for opening plastic bags travelling on a conveyor and containing recyclable materials, the apparatus comprising:

a) a conveyor hood positioned above and along the conveyor; and b) a plurality of bag opener units mounted within said conveyor hood, each of said bag opener units comprising a flexible line connected to a rotating head, and a cover to partially enclose the rotating head and the flexible line, whereby the flexible lines open the plastic bags as the lines are rotated by the heads and as the plastic bags are transported through said conveyor hood by the conveyor.

9. The apparatus of claim 8, wherein said conveyor hood comprises a plate positioned between said plurality of bag opener units and the conveyor, said plate defining a plurality of slots, and further wherein the free ends of the flexible lines of said bag opener units are whirled through the slots in said plate and into contact with the plastic bags.

10. The apparatus of claim 9 wherein each of said plurality of bag opener units is mounted in said conveyor hood upon a support bar extending upwardly from the plate.

11. The apparatus of claim 8 wherein said plurality of bag opener units are mounted above the conveyor.

12. The apparatus of claim 8, further comprising a sorting conveyor positioned to receive the plastic bags and the recyclable materials contained therein from the conveyor after the plastic bags are opened by said plurality of bag opener units.

13. The apparatus of claim 8 wherein said plurality of bag opener units is mounted within said conveyor hood such that a plane of rotation of the rotating heads and the flexible lines forms an angle with the centerline of the conveyor.

14. An apparatus for opening plastic bags travelling on a conveyor and containing recyclable materials, the apparatus comprising:

a) a conveyor hood positioned above and along the conveyor; and b) a plurality of bag opener units mounted within said conveyor hood, each of said bag opener units comprising a flexible line connected to a rotating head, whereby the flexible lines open the plastic bags as the lines are rotated by the heads and as the plastic bags are transported through said conveyor hood by the conveyor;

wherein said conveyor hood comprises a plate positioned between said plurality of bag opener units and the conveyor, said plate defining a plurality of slots, and further wherein the free ends of the flexible lines of said bag opener units are whirled through the slots in said plate and into contact with the plastic bags.

15. The apparatus of claim 14 wherein each of the flexible lines comprises a braided line.

16. An apparatus for opening plastic bags travelling on a conveyor and containing recyclable materials, the apparatus comprising:

a) a conveyor hood positioned above and along the conveyor; and b) a plurality of bag opener units mounted within said conveyor hood, each of said bag opener units comprising a flexible line connected to a rotating head, whereby the flexible lines open the plastic bags as the lines are rotated by the heads and as the plastic bags are transported through said conveyor hood by the conveyor;

wherein said conveyor hood comprises a plate positioned between said plurality of bag opener units and the conveyor, each of said plurality of bag opener units being mounted upon a support bar extending upwardly from said plate, said plate defining a plurality of slots, and further wherein the free ends of the flexible lines of said bag opener units are whirled through the slots in said plate and into contact with the plastic bags.

* * * * *